US007690361B2

(12) United States Patent
Vogt et al.

(10) Patent No.: US 7,690,361 B2
(45) Date of Patent: Apr. 6, 2010

(54) SYSTEM AND METHOD FOR METERING FUEL IN A HIGH PRESSURE PUMP SYSTEM

(75) Inventors: Kevin L. Vogt, Columbus, IN (US); Jung-Min C. Sung, Columbus, IN (US); Michael A. Lucas, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 11/905,410

(22) Filed: Sep. 28, 2007

(65) Prior Publication Data

US 2009/0084355 A1 Apr. 2, 2009

(51) Int. Cl.
*F02M 37/00* (2006.01)
*F02M 37/08* (2006.01)

(52) U.S. Cl. ..... 123/514; 123/506

(58) Field of Classification Search ..... 123/514, 123/506, 511, 515, 507, 459, 461, 462, 456
See application file for complete search history.

(56) References Cited

U.S. PATENT DOCUMENTS 3,702,122 A * 11/1972 Hanaoka ..... 137/805
5,133,324 A * 7/1992 Michiaki ..... 123/514
5,404,855 A 4/1995 Yen
5,983,869 A * 11/1999 Cooke et al. ..... 123/514
6,615,806 B2 9/2003 Schueler
6,772,734 B2 8/2004 Schueler
2007/0238003 A1 * 10/2007 Larrain et al. ..... 429/34

FOREIGN PATENT DOCUMENTS

DE 19742180 A1 3/1999
EP 0735268 A2 10/1996

OTHER PUBLICATIONS

International Search Report dated on Apr. 10, 2009 for International application No. PCT/US2008/076357.
PCT Written Opinion of the International Searching Authority mailed on April 10, 2009; International Application No. PCT/US2008/076357.

* cited by examiner

*Primary Examiner*—Mahmoud Gimie
(74) *Attorney, Agent, or Firm*—Studebaker & Brackett PC; Tim L. Brackett, Jr.; J. Bruce Schelkopf

(57) ABSTRACT

A system and method for metering fuel is provided which includes a fuel supply line and a metering valve in fluid connection with the fuel supply line to control a flow of fuel through the fuel supply line. The valve is movable into a closed position to block a primary flow of fuel and create a leakage fuel flow in the fuel supply line downstream of the metering valve. The system also includes a venturi apparatus fluidly coupled to the fuel supply line upstream of the metering valve. The venturi apparatus is further coupled to the fuel supply line downstream of the metering valve to direct the leakage fuel flow out of the fuel supply line.

16 Claims, 4 Drawing Sheets

SYSTEM AND METHOD FOR METERING FUEL IN A HIGH PRESSURE PUMP SYSTEM

TECHNICAL FIELD

The invention relates generally to high pressure pump systems and, more particularly, to a system and method for metering fuel to a high pressure fuel pump.

BACKGROUND OF THE INVENTION

With the advent of increased fuel economy and reduced emissions requirements imposed by the government, various fuel systems have been developed to precisely control the amount of fuel that is injected during the injection events of a combustion cycle. In particular, high pressure fuel injection systems have been developed which provide increased control of the fuel injected by the fuel injectors of an internal combustion engine in comparison to conventional fuel injection systems.

Such high pressure fuel injection systems typically utilize at least one high pressure pump that pressurizes the fuel to be injected by the fuel injectors. Fuel systems may utilize a plurality of such high pressure pumps corresponding to the number of fuel injectors, each of the pumps providing highly pressurized fuel to a fuel injector. Other fuel systems utilize fewer high pressure pumps in conjunction with a high pressure common rail. The high pressure common rail may include a common rail fuel apparatus such as a high pressure accumulator. In an exemplary design, one or more high pressure pumps are connected to the high pressure common rail to thereby provide highly pressurized fuel to the fuel injectors of the internal combustion engine. The common rail then distributes the pressurized fuel to each of the fuel injectors.

Some high pressure fuel injection systems utilizes a hydro mechanical actuator to precisely control the quantity of fuel to be admitted to the high pressure fuel pump. In FIG. 1, for example, a conventional high pressure fuel pump system 10 is illustrated. A fuel supply 12 is dispersed in a supply line 14 such as via a low pressure fuel transfer pump (not shown). A hydro mechanical actuator 16 is configured to control the quantity of fuel 12 dispersed towards one or more high pressure fuel pumps 30. The fuel pumps 30 can include a high pressure piston pump suitable for dispersing fuel from a fuel supply 12 to a receptacle such as a common rail fuel apparatus or accumulator 42. An air bleed orifice 18 is provided to disperse air from within the supply, line 14 upstream to the hydro mechanical actuator 16. The hydro mechanical actuator 16 may include an inlet metering valve (IMV) having a variable area orifice operated, for example, by a solenoid. Thus, the IMV can include a variable area sleeve type valve that uses linear position to control the amount of fuel to be pumped through the supply line 14 towards one or more fuel pumps 30. Hence, the IMV is configured such that it may be actuated to a fully closed position in order to prevent fuel from passing downstream to the fuel pump 30. However, by nature of the sleeve type valve design, there may be a natural leakage rate that passes through the clearance of the sleeve valve.

A design of the conventional high pressure fuel pump system 10 shown in FIG. 1 includes inlet check valves 26 which allow fuel to be fed to one or more fuel pumps 30 via supply lines 28. The inlet check valves 26 are configured to open after a pressure buildup within the inlet check valve passage 17. This tolerance pressure may occur, for example, at 7 psi. Thus, when the pressure buildup exceeds 7 psi, the inlet check valve 26 opens to allow a flow of fuel to pass therethrough. The aforementioned pressure buildup may occur prematurely due to any fuel flow leakage from the IMV 16. The pressure buildup in the inlet check valve passage 17 can occur downstream to the IMV 16. Thus, once the tolerance pressure, for example, 7 psi, is achieved, the inlet check valve 26 is opened to allow fuel to be fed to fuel pump 30.

The exemplary embodiment of FIG. 1 illustrates a plurality of high pressure fuel pumps 30 which are driven via cams 32 and followers 34 in order to drive fuel towards outlet check valves 38 via supply lines 36. Again, the outlet check valves 38 are also configured to open, upon achieving a tolerance pressure, in order to allow fuel to pass therethrough towards the common rail fuel apparatus or high pressure accumulator 42. Upon obtaining the tolerance pressure, the outlet check valves 38 open and allow fuel to pass therethrough to be received by the accumulator 42 via supply lines 40.

Hence, under ideal circumstances, the fuel is precisely regulated from the fuel supply 12 via the IMV 16. This would, in turn, regulate an amount of fuel delivered to one or more fuel pumps 30. However, due to leakage of fuel past the IMV 16 into the inlet check valve passage 17 downstream to the IMV 16, the additional amount of fuel flow leakage can pressurize the system. The IMV 16 fuel leakage rate may be measured at approximately 5-40 cc/min. The presence of this additional fuel leakage within the high pressure fuel pump system 10 can produce additional pressurization downstream to the IMV 16 such as within in the inlet check valve passage 17 and at one or more inlet check valves 26. The increased pressurization can be sufficient to achieve the minimum tolerance pressure of the inlet check valves 26 and cause them to open. This will allow additional fuel to flow to one or more fuel pumps 30. Upon operation, the receipt of the aforementioned additional leakage of fuel flow received by one or more fuel pumps 30 will increase the pressure in supply lines 36 toward one or more outlet check valves 38. This additional pressurization created in supply lines 36 can achieve the minimum tolerance pressure of valves 38 required for opening and upon doing so will therefore allow additional fuel to flow towards accumulator 42. This additional amount of fuel can over-pressurize the accumulator 42 thus creating potentially negative effects.

In one example, a diesel engine may be equipped with the conventional high pressure fuel pump system 10 of FIG. 1. When the diesel engine is motored down, such as upon encountering long mountain grades, with a closed throttle pedal, the IMV 16 is commanded fully closed to prevent fuel from entering the fuel pump 30. However, the before mentioned leakage of fuel flowing past the IMV sleeve valve may be admitted to the fuel pump 30 where it is pressurized and delivered to the high pressure accumulator 42. The flow of fuel into the accumulator 42 during closed throttle engine motoring is undesired and causes the accumulator pressure to rise above the target pressure.

When the target pressure of the accumulator is exceeded, several undesirable effects may occur. For example, upon reopening the IMV 16, such as via the throttle pedal, an undesirable combustion noise may occur due to a fuel injection event occurring at higher pressures. Increased pressure may negatively affect components such as by reducing the service life of engine seals or causing other engine components to fail. Such failures may include creating fractures in fuel system components including, for example, fuel injector bodies.

Embodiments of accumulators 42 having pressure safety relief valves may also be affected. For example, undesirable increased pressure, as described herein, may trigger a relief valve to open in order to prevent the system from buildup of excessive pressure. However, continuous multiple and repetitive relief valve opening events, such as those occurring subsequent to encountering long mountain grades, occurring during unexpected openings as a result of fuel leakage from the IMV, can reduce the service life of the relief valve. This can induce increased costs for repair and possibly incur additional damages to the accumulator itself if the relief valve fails prematurely before being noticed. Damage to the accumulator could also adversely affect other components of the vehicle including creating additional damages.

Turning again to FIG. 1, a fuel drain supply line 22 is fluidly connected to fuel pump drain 44 of fuel drain circuit 20. The fuel drain supply line 22 receives fuel from one or more high pressure pumps 30. In some instances, the one or more fuel pumps 30 can operate even when the IMV 16 is in a closed position. Such operation may draw fuel from the fuel drain supply line 22 and pressurize the aforementioned fuel, for example, as the cam 32 enacts the piston of the piston fuel pump 30 in a stroke motion. This, too, can cause over-pressurization of the fuel pump system 10 including over-pressurizing components such as accumulator 42.

Thus, there exists a need to prevent undesirable pressure buildup within the high pressure fuel injection system and to address, at least, the aforementioned problems of the prior art.

The present disclosure is directed towards overcoming one or more shortcomings set forth above.

SUMMARY OF THE INVENTION

It is, therefore, one object of the present invention to overcome the deficiencies of the prior art and to provide a system for metering fuel including a fuel supply line and a metering valve in fluid connection with the fuel supply line to control a flow of fuel through the fuel supply line. The valve may be moved into a closed position to block a primary flow of fuel and create a leakage fuel flow in the fuel supply line downstream of the metering valve. The system may further include a venturi apparatus fluidly coupled to the fuel supply line upstream of the metering valve. The venturi apparatus may be further coupled to the fuel supply line downstream of the metering valve to direct the leakage fuel flow out of the fuel supply line.

In accordance with yet another disclosed exemplary embodiment, a high pressure fuel injection system for pressurizing a common rail fuel apparatus to a predetermined pressure range includes at least one high pressure fuel pump coupled to the common rail fuel apparatus and a fuel supply line in fluid connection with the at least one high pressure fuel pump. The system may also include a metering valve in fluid connection with the fuel supply line to control a flow of fuel through the fuel supply line. The valve is movable into a closed position to block a primary flow of fuel and create a leakage fuel flow in the fuel supply line downstream of the metering valve. The venturi apparatus is fluidly coupled to the fuel supply line upstream of the metering valve. The venturi apparatus may be further coupled to the fuel supply line downstream of the metering valve to direct the leakage fuel flow away from the at least one high pressure fuel pump.

In accordance with another disclosed exemplary embodiment, a system for metering fuel to a high pressure fuel pump includes a means for supplying fuel to a high pressure fuel pump and a means for metering the quantity of fuel supplied to the high pressure fuel pump at a point upstream to the high pressure fuel pump. The system may also include a means for preventing fuel from being pressurized by the high pressure fuel pump at a point downstream to the metering point and upstream to the high pressure fuel pump.

In accordance with yet another disclosed exemplary embodiment, a method of metering fuel to a high pressure fuel pump comprising supplying fuel to a high pressure fuel pump and metering the quantity of fuel supplied to the high pressure fuel pump at a point upstream of the high pressure fuel pump. The method may also include preventing fuel from being pressurized by the high pressure fuel pump at a point downstream of the metering point and upstream of the high pressure fuel pump.

In accordance with another disclosed exemplary embodiment, a method of pressurizing an accumulator to a predetermined pressure range includes supplying fuel to at least one high pressure fuel pump fluidly coupled to the accumulator and metering the quantity of fuel supplied to the at least one high pressure fuel pump at a point upstream of the at least one high pressure fuel pump. The method may also include preventing fuel from being pressurized by the at least one high pressure fuel pump at a point downstream of the metering point and upstream of the at least one high pressure fuel pump. A low pressure zone may be formed in the fuel supply downstream of the metering point and upstream of the at least one high pressure fuel pump to regulate a pressure of the accumulator within a predetermined range.

DETAILED DESCRIPTION OF THE INVENTION

Figure 1:
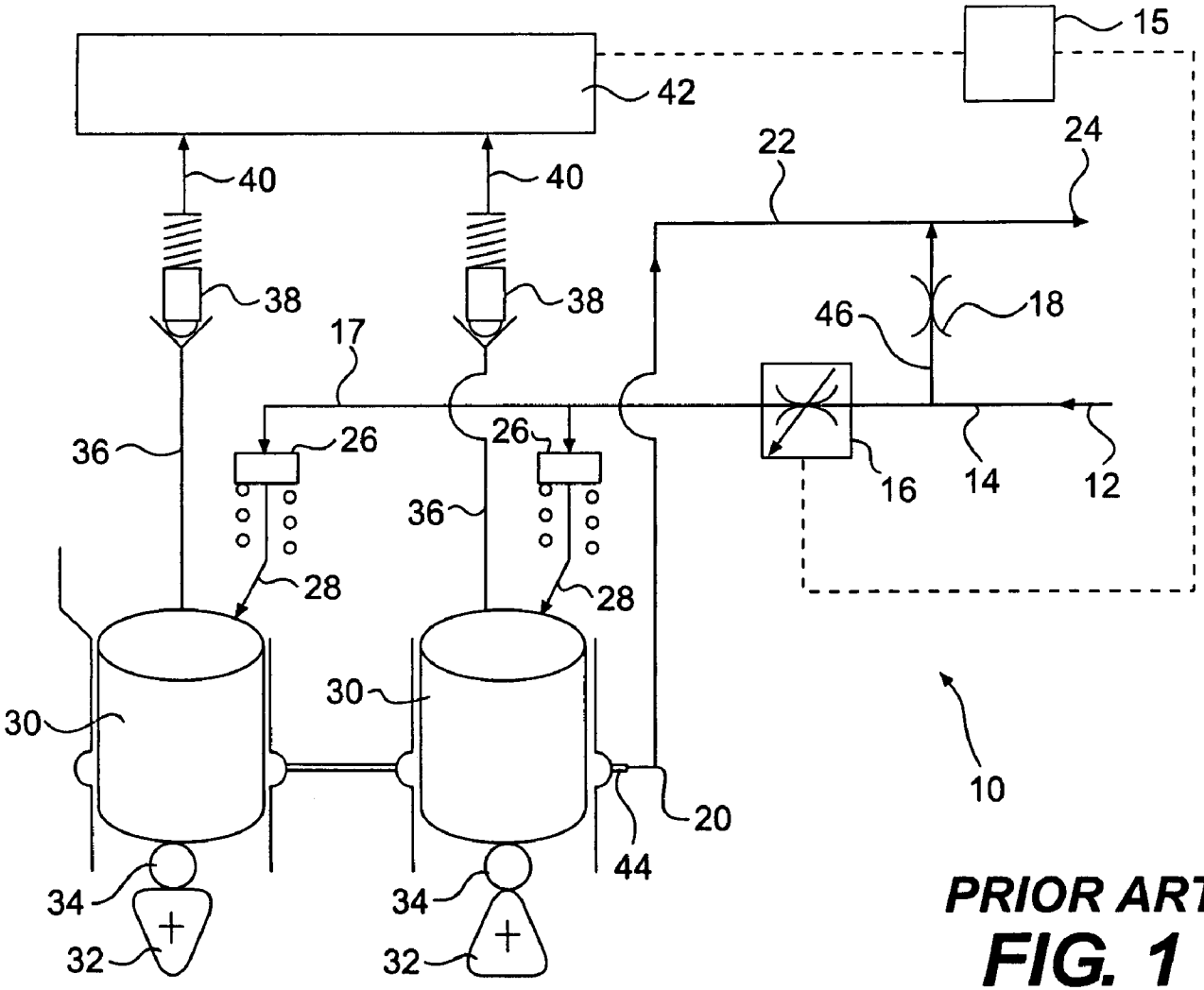
PRIOR ART FIG. 1
FIG. 1 is a schematic illustration of a conventional high pressure fuel injection system.
Figure 2:
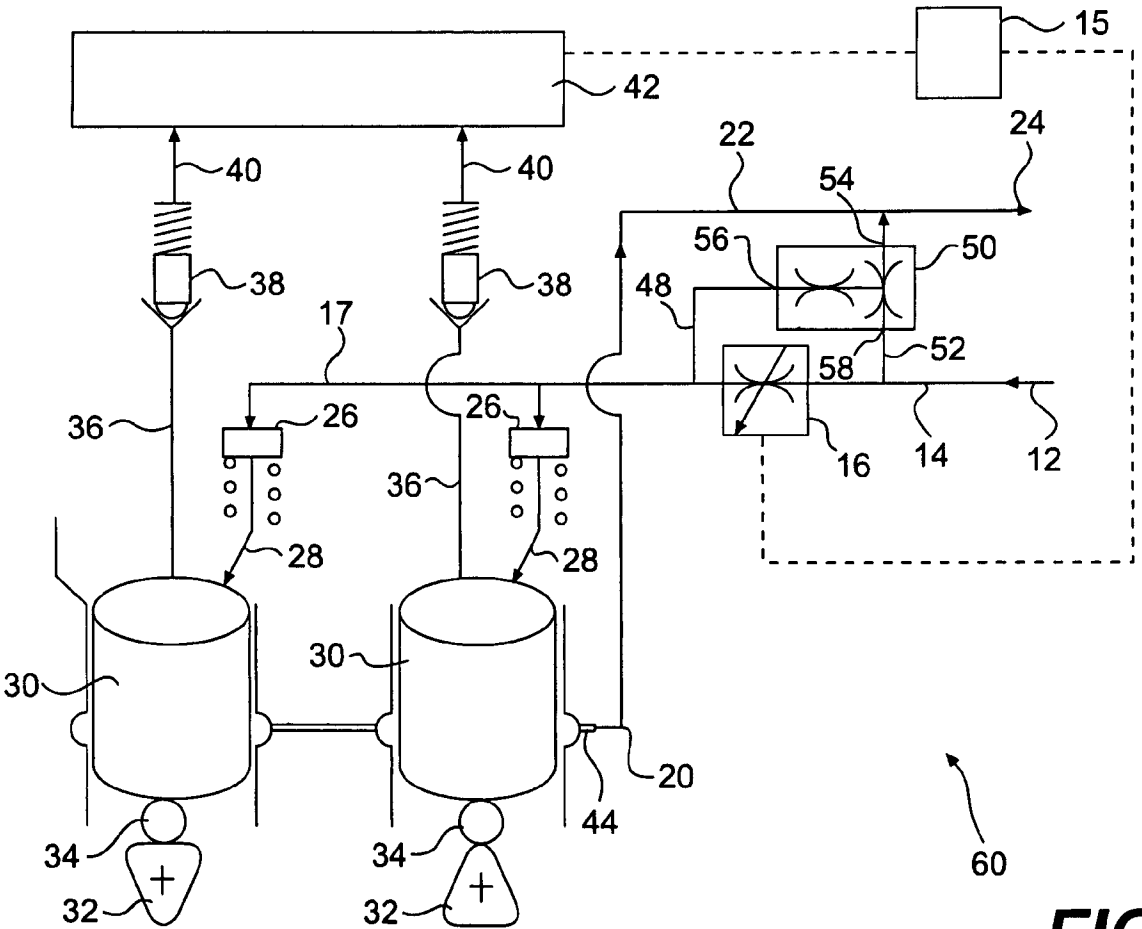
FIG. 2 is a schematic illustration of a high pressure fuel injection system according to an exemplary disclosed embodiment.

The invention will now be described with reference to the drawing figures, in which like reference numerals refer to like parts throughout. Referring to FIG. 2, an enhanced high pressure fuel pump system 60 for use in a work machine. Work machine may refer to any type of fixed or mobile machine that performs some type of operation associated with a particular industry, such as mining, construction, farming, transportation, etc., and operates between or within work environments (e.g., construction site, mine site, power plants, on-highway applications, etc.). Non-limiting examples of work machines may include commercial machines, such as cranes, earth moving work machines, other material handling equipment, farming equipment, marine vessels, aircraft, and any type of machine that operates in a work environment. Work machine may also refer to any type of automobile or other type of commercial vehicle.

Fuel supply 12 is dispersed into supply line 14. In one exemplary embodiment, the fuel supply 12 may be dispersed via operation of a low pressure fuel transfer pump (not shown). A hydro mechanical actuator 16 is configured to control the quantity of fuel 12 dispersed towards one or more high pressure fuel pumps 30. While a selected number of high pressure fuel pumps 30 are shown in the figures, it is understood that any number of high pressure fuel pumps 30 may be utilized by the present invention suitable, for example, for providing pressurized fuel for use by a pre-selected number of fuel injectors in a high pressure fuel injection system. The fuel pumps 30 may include a high pressure piston pump suitable for dispersing fuel from a fuel supply 12 to a common rail fuel apparatus or accumulator 42. Embodiments of the fuel pump 30 design may include a floating plunger pump, a positive displacement pump or retracted plunger pump design or other suitable design for pumping pressurized fuel in a high pressure fuel pump system. In a preferred design of the present invention, a floating plunger pump is utilized in which fuel is injected into pump 30 via supply line 28 to enact movement of a plunger of fuel pump 30 in a stroke motion. Cam 32 is enabled to provide a return motion of the fuel pump 30 plunger to compress the fuel under high pressure.

The hydro mechanical actuator 16 may include an inlet metering valve (IMV) having a variable area orifice operated, for example, by a solenoid. Thus, the IMV can include a variable area sleeve type valve that uses linear position to control the amount of fuel to be pumped. One embodiment of the hydro mechanical actuator 16 design is evidenced in commonly owned U.S. Pat. No. 5,404,855 which is fully incorporated herein by reference. Hence, the IMV is commanded to be fully closed to otherwise prevent fuel being passed to the fuel pump 30 from the supply line 14. Yet, by nature of the sleeve type valve, there may be a natural leakage rate that passes through the clearance of the sleeve valve and into the inlet check valve passage 17. Upon sufficient pressurization of fuel within the inlet check valve passage 17, the tolerance pressure of check valve 26 may be achieved (as earlier described) in which the leakage fuel flow is admitted to the fuel pumps 30, upon which, over-pressurization of the leakage fuel flow may occur.

The present invention further includes a venturi apparatus 50 disposed within a continuous fuel flow circuit. The fuel flow circuit includes a supply line 52 having one end fluidly connected to the venturi apparatus 50. The other end of the supply line 52 is disposed upstream to the IMV 16 in fluid connection with the supply line 14. Supply line 52 in connection with the venturi apparatus 50 acts as an air bleed orifice to disperse air from within the supply line 14 upstream to IMV 16. The fuel flow circuit further includes a inlet venturi passage 48 having one end fluidly connected to the venturi apparatus 50 at inlet 56. The other end of the inlet venturi passage 48 is disposed downstream to the IMV 16 in fluid connection with the inlet check valve passage 17. As shown in FIG. 2, both ends of the supply line 52 and inlet venturi passage 48 are fluidly connected to supply line 14 and inlet check valve passage 17, respectively, are disposed upstream to the one or more fuel pumps 30.

A fuel pump drain circuit 20 is provided which, in one embodiment, connects a fuel pump drain 44 to a fuel drain supply line 22. The fuel drain supply line 22 may be fluidly connected to a fuel drain 24 of a fuel tank (not shown). In a preferred embodiment, the fuel flow circuit comprises an output 54 of the venturi apparatus 50 which is fluidly connected to fuel drain supply line 22. As further described below, the disclosed venturi apparatus 50 enables fuel within the fuel drain supply line 22 to flow towards the fuel drain 24 and away from the one or more fuel pumps 30.

The venturi apparatus 50 utilizes the continuous fuel flow circuit, including the portion that is upstream of the IMV 16. In one preferred embodiment, this includes the portion of the continuous fuel flow circuit that is immediately upstream of the IMV 16 to form a low pressure region within the throttling area of the venture apparatus 50. The continuous fuel flow circuit connects the low pressure zone of the venturi apparatus 50 to the inlet metering circuit of the piston type fuel pump 30. The venturi apparatus 50 causes any leakage of fuel flow from the IMV to be directed back towards the fuel drain 24, and away from the one or more fuel pumps 30, so that the leakage of fuel flow is not pressurized by the one or more fuel pumps 30. By design, the disclosed venturi apparatus 50 combines the functions of a vapor removing bypass flowing upstream of the IMV 16 and removal of the leakage of fuel flow from the IMV 16 downstream of the fully closed IMV 16.

Figure 3B:
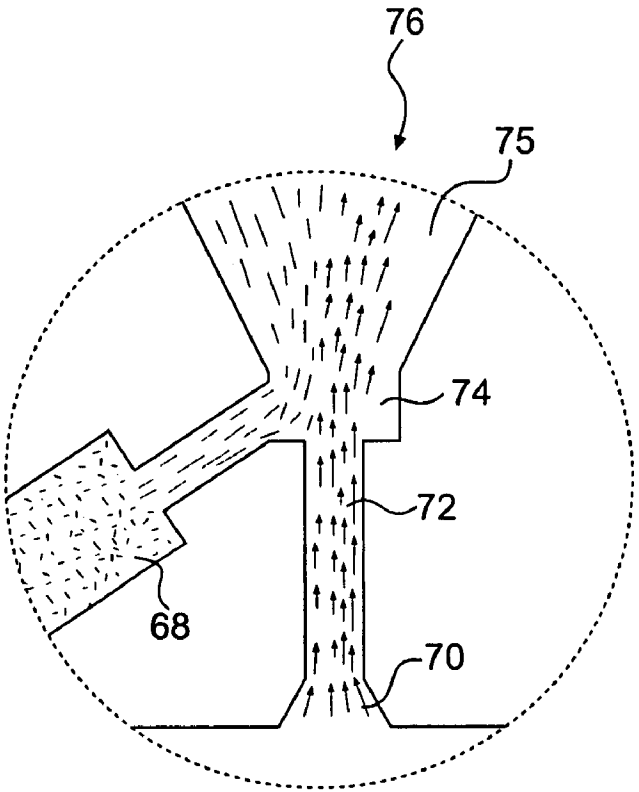
FIG. 3B provides an enlarged diagrammatic view of the throttling area of the venturi apparatus of FIG. 3A.
Figure 3A:
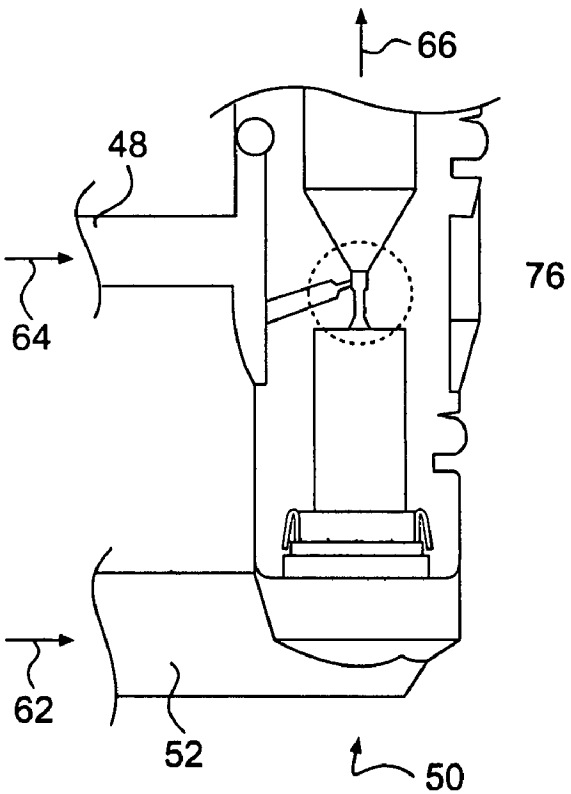
FIG. 3A provides a diagrammatic view of a venturi apparatus according to an exemplary disclosed embodiment.

Turning to FIG. 3A, the venturi apparatus 50 is illustrated in fluid connection with inlet venturi passage 48 and supply line 52. Inlet flow directions 64 and 62 are shown with corresponding inlet venturi passage 48 and supply line 52, respectively. An outlet flow direction 66 is shown illustrating the flow direction of either fuel or dispersed air from within the venturi apparatus 50 towards supply line 22 (FIG. 2) directing fuel/air flow back towards the fuel drain 24 to a fuel tank (not shown) and away from one or more fuel pumps 30. The geometry of the venturi apparatus 50 is designed and optimized to develop the best case low pressure region for the leakage of fuel flow from IMV 1.6 to flow into. Continuous flow rate through the throttling area 76 of the venturi apparatus 50 causes a low pressure region that draws the IMV 16 leakage flow into the fuel pump drain circuit 20.

Turning to FIG. 3B, an exploded view of the throttling area 76 of the venturi apparatus 50 is shown. As disclosed above, the venturi apparatus 50 combines the functions of a vapor removing bypass flowing upstream of the IMV 16 and removal of IMV 16 leakage flow downstream of a fully closed IMV 16. An embodiment of the present invention provides supply line 52 to direct vapor from supply line 14 to the venturi apparatus 50, wherein the vapor is shown moving through inlet area 70 through air bleed orifice 72 towards low pressure region 74. Inlet venturi passage 48 is configured to direct fuel flow from inlet check valve passage 17 into the venturi apparatus 50. Thus, leakage of fuel flow 68 downstream of IMV 16 is directed towards low pressure region 74 of the venturi apparatus 50. In one embodiment, the venturi apparatus 50 may include an expanded region 75 of the low pressure region 74 which can generate even lower pressures to induce fuel/air flow in the outlet flow direction 66 back towards fuel drain 24. Hence, under normal conditions of vehicle operation, the venturi apparatus 50 will cause IMV leakage flow 68 to move away from the fuel pump 30. This occurs by drawing and diverting the IMV leakage flow 68 to the fuel drain supply line 22 before it reaches the inlet check valve 26 of the high pressure fuel pump 30 and being pumped into the accumulator 42.

The present invention also reduces the sensitivity of unintended pumping when the drain pressure is at or slightly above the opening pressure of the inlet check valve 26 (FIG. 2) of the fuel pump 30. Thus, another advantage of the present invention includes the disclosed venturi apparatus 50 which prevents the high pressure fuel pump 30 from drawing fuel from the fuel drain supply line 22 and pumping that fuel into the high pressure accumulator 42. The venturi apparatus 50 provides a lower pressure zone to prevent a higher back pressure into the fuel drain supply line 22 back towards fuel pump 30. Thus, the fuel pump 30 is not able to receive fuel from the fuel drain supply line 22 which could be further pressurized by enablement of the cam 32 action to drive the plunger of fuel pump 30 and, hence, pressurize fuel received from the fuel drain supply line 22.

Figure 4:
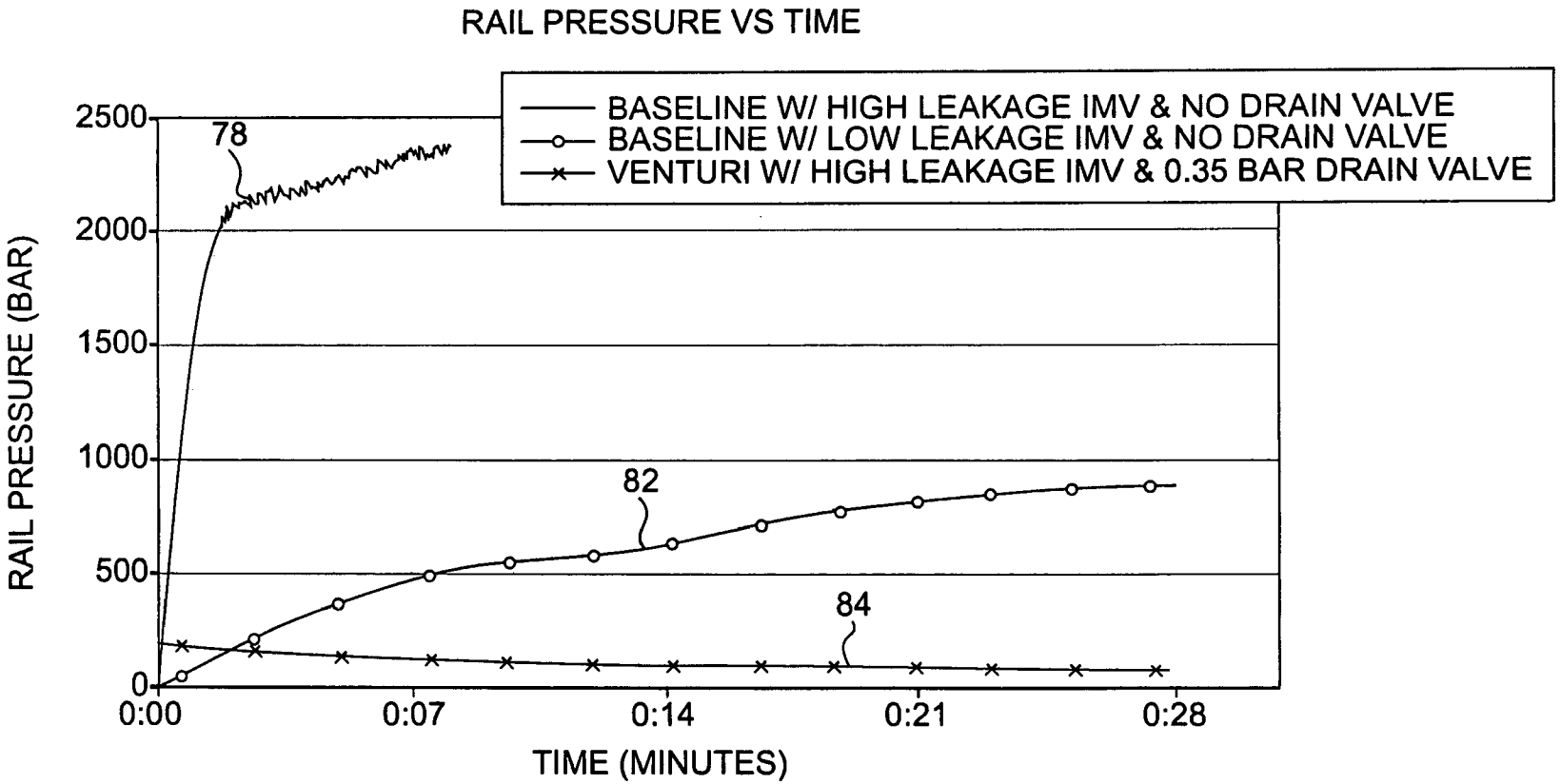
FIG. 4 provides a graphical illustration of pressure values over time utilizing exemplary disclosed embodiments.

FIG. 4 provides a graphical illustration of an embodiment with and without the disclosed invention implemented within a high pressure fuel system. Plot 78 illustrates pressure values over time in a high pressure fuel system having no venturi apparatus 50 and a high leakage flow rate from a fully closed IMV 16 during a closed throttle motoring operation. As shown in FIG. 4, the resulting pressure values are significantly high ranging between approximately 2000-2400 BAR. It is also noted that the pressure generally increases over time.

The implantation of disclosed embodiments of the invention provide a reduction of pressure over time as evidenced, for example, in FIG. 4 Even in cases wherein the leakage of fuel from the IMV 16 is relatively low, the disclosed venturi apparatus 50 provides advantages for achieving or maintaining lower pressure ranges within high pressure fuel systems. For example, plot 82 illustrates pressure values over time in a high pressure fuel system having no venturi apparatus 50 and a low leakage flow rate from a fully closed IMV 16 during a closed throttle motoring operation. The resulting pressure values increase over time from approximately 0-1000 BAR. Plot 84 illustrates pressure values over time in a high pressure fuel system having the disclosed venturi apparatus 50 (having a 0.35 BAR drain value) and still a high leakage flow rate from a fully closed IMV 16 during a closed throttle motoring operation. Nevertheless, the resulting pressure values generally decrease over time from approximately 200-100 BAR.

Thus, it is readily apparent that disclosed embodiments of the present invention may pressurize components of high pressure fuel injection systems 60 to within predetermined pressure ranges. Given this ability, it is therefore possible for disclosed embodiments of the present invention to facilitate efforts in order to avoid over-pressurization of fuel injection systems and associated components. This may further prevent damaging fuel injection systems and associated components by preserving or extending the service life of the system and its components. To this end, further advantages of the present disclosure include preventing undesirable pressure buildup within high pressure fuel injection systems 60 by providing a system and method for causing fuel flow leakage to flow away from a high pressure fuel pump system in order to prevent undesirable pressurization of the fuel flow leakage in the high pressure fuel pump system 60 during operation. Moreover, additional advantages of the present disclosure further include preventing the high pressure fuel pumping system (such as high pressure fuel pump 30) from drawing fuel from a fuel drain supply line 22 and pumping that fuel into components of the high pressure fuel pump system 60 (such as the high pressure accumulator 42) wherein over-pressurization may occur.

It will be apparent to those skilled in the art that various modifications and variations can be made in the disclosed apparatus and method without departing from the scope of the disclosure. Additionally, other embodiments of the apparatus and method will be apparent to those skilled in the art from consideration of the specification. It is intended that the specification and examples be considered as exemplary only, with a true scope of the disclosure being indicated by the following claims and their equivalents.

What is claimed is:

1. A system for metering fuel to at least one high pressure fuel pump, comprising:

a fuel supply line in fluid connection with said at least one high pressure fuel pump;

a metering valve in fluid connection with said fuel supply line to control a flow of fuel through said fuel supply line, said valve movable into a closed position to block a primary flow of fuel and create a leakage fuel flow in said fuel supply line downstream of said metering valve; and a venturi apparatus fluidly coupled to said fuel supply line upstream of said metering valve, said venturi apparatus further coupled to said fuel supply line downstream of said metering valve to direct said leakage fuel flow away from said at least one high pressure fuel pump.

2. The system of claim 1, wherein said at least one high pressure fuel pump comprises a plurality of high pressure fuel pumps.

3. The system of claim 1, wherein the venturi apparatus directs gas out of said fuel supply line.

4. The system of claim 1, wherein the venture apparatus is configured to produce a low pressure region downstream to the metering valve when said material valve is closed.

5. The system of claim 4, wherein the low pressure region is maintained between approximately 5-10 psi.

6. The system of claim 1, further comprising:

an outlet of said venturi apparatus; and a fuel drain line fluidly coupled to the outlet and the at least one high pressure pump, wherein the venturi apparatus directs fuel in the fuel drain line away from said at least one high pressure pump.

7. A high pressure fuel injection system for pressurizing a common rail fuel apparatus to a predetermined pressure range comprising:

at least one high pressure fuel pump coupled to said common rail fuel apparatus;

a fuel supply line in fluid connection with said at least one high pressure fuel pump;

a metering valve in fluid connection with said fuel supply line to control a flow of fuel through said fuel supply line, said valve movable into a closed position to block a primary flow of fuel and create a leakage fuel flow in said fuel supply line downstream of said metering valve; and a venturi apparatus fluidly coupled to said fuel supply line upstream of said metering valve, said venturi apparatus further coupled to said fuel supply line downstream of said metering valve to direct said leakage fuel flow away from said at least one high pressure fuel pump.

8. The system of claim 7, comprising:

an outlet of said venturi apparatus; and a fuel drain line fluidly coupled to the outlet and the at least one high pressure pump, wherein the venturi apparatus directs fuel in the fuel drain line away from said at least one high pressure pump.

9. A system for metering fuel to a high pressure fuel pump comprising:

means for supplying fuel to a high pressure fuel pump;

means for metering the quantity of fuel supplied to the high pressure fuel pump at a point upstream to said high pressure fuel pump; and venturi apparatus fluidly coupled to the means for supplying fuel upstream of the metering point, and fluidly coupled to the means for supplying fuel downstream of the metering point and upstream of said high pressure fuel pump, for preventing fuel from being pressurized by the high pressure fuel pump at a point downstream to the metering point and upstream to said high pressure fuel pump.

10. The system of claim 9, wherein the metering means comprises a hydro mechanical actuator.

11. The system of claim 10, wherein the hydro mechanical actuator includes an inlet metering valve.

12. A method of metering fuel to a high pressure fuel pump comprising:

supply fuel to a high pressure fuel pump;

metering the quantity of fuel supplied to the high pressure fuel pump at a point upstream of said high pressure fuel pump;

preventing fuel from being pressurized by the high pressure fuel pump at a point downstream of the metering point the upstream of said high pressure fuel pump by using a venturi apparatus fluidly coupled to the fuel supply upstream of the metering point, and fluidly coupled to the fuel supply downstream of the metering point and upstream of said high pressure fuel pump, to form a low pressure zone in the fuel supply downstream of the metering point and upstream of said high pressure fuel pump.

13. The method of claim 12, further comprising:

maintaining the low pressure zone between approximately 5-10 psi.

14. The method of claim 12, further comprising:

removing gas from the fuel supply at a point upstream of the metering point.

15. A method of pressurizing an accumulator to a predetermined pressure range, comprising:

suppling fuel to at least one high pressure fuel pump fluidly coupled to said accumulator;

metering the quantity of fuel supplied to the at least one high pressure fuel pump at a point upstream of said at least one high pressure fuel pump;

preventing fuel from being pressurized by said at least one high pressure fuel pump at a point downstream of the metering point and upstream of said at least one high pressure fuel pump by using a venturi apparatus fluidly coupled to the fuel supply upstream of the metering point, and fluidly coupled to the fuel supply downstream of the metering point and upstream of said high pressure fuel pump to form a low pressure zone in the fuel supply downstream of the metering point and upstream of said at least one high pressure fuel pump to regulate a pressure of the accumulator within a predetermined range.

16. The method of claim 15, further comprising:

preventing pumping by the at least one high pressure fuel pump to regulate pressure of the accumulator.

* * * * *